US008322508B2

(12) United States Patent
Matheisl et al.

(10) Patent No.: US 8,322,508 B2
(45) Date of Patent: Dec. 4, 2012

(54) STEP SUPPORT OR PLATE SUPPORT FOR TREAD UNITS OF A CONVEYING DEVICE, TREAD UNITS AND CONVEYING DEVICE

(75) Inventors: Michael Matheisl, Österreich (AT); Thomas Illedits, Österreich (AT); Thomas Novacek, Österreich (AT); Harald Gössl, Österreich (AT)

(73) Assignee: Inventio AG, Hergiswil NW (CH)

( * ) Notice: Subject to any disclaimer, the term of this patent is extended or adjusted under 35 U.S.C. 154(b) by 278 days.

(21) Appl. No.: 12/680,759

(22) PCT Filed: Sep. 26, 2008

(86) PCT No.: PCT/EP2008/062970

§ 371 (c)(1), (2), (4) Date: Mar. 30, 2010

(87) PCT Pub. No.: WO2009/047146

PCT Pub. Date: Apr. 16, 2009

(65) Prior Publication Data

US 2010/0213025 A1 Aug. 26, 2010

(30) Foreign Application Priority Data

Oct. 1, 2007 (EP) ..... 07117646

(51) Int. Cl.
*B66B 23/12* (2006.01)
*B66B 21/02* (2006.01)

(52) U.S. Cl. ..... 198/333; 198/327; 198/326

(58) Field of Classification Search ..... None
See application file for complete search history.

(56) References Cited

U.S. PATENT DOCUMENTS

| | | | | |
|---|---|---|---|---|
| 5,988,350 | A | 11/1999 | Nusime | |
| 2007/0205080 | A1 * | 9/2007 | Streibig et al. | 198/333 |

FOREIGN PATENT DOCUMENTS

| | | | |
|---|---|---|---|
| DE | 69 443 | A | 10/1969 |
| DE | 20 51 802 | A1 | 4/1972 |
| FR | 2 152 615 | A | 4/1973 |
| GB | 2 216 825 | A | 10/1989 |
| JP | 08 245152 | A | 9/1996 |
| JP | 2001 316065 | A | 11/2001 |

* cited by examiner

*Primary Examiner* — Kavel Singh
(74) *Attorney, Agent, or Firm* — Ladas & Parry LLP

(57) ABSTRACT

The step support (17) or plate support comprises a rear crossmember (22) and a front crossmember (24) which together form a plane (E3) for receiving the tread element (9). There are two outer step cheeks (20.1, 20.2), wherein one of the step cheeks (20.1) is arranged on the right and one of the step cheeks (20.2) is arranged on the left, substantially perpendicular with respect to the crossmembers (22, 24). The two crossmembers (22, 24) are manufactured from deep-drawing sheet metal and are welded or joined or riveted or screwed or adhesively bonded or clinched to the step cheeks (20.1, 20.2) or plate cheeks to form a load-hearing frame. The height (H2) of the crossmembers (22, 24) at its ends is smaller than the height (H3) of the crossmembers (22, 24) in the center, with the result that the crossmembers (22, 24) have a curved shape.

21 Claims, 16 Drawing Sheets

STEP SUPPORT OR PLATE SUPPORT FOR TREAD UNITS OF A CONVEYING DEVICE, TREAD UNITS AND CONVEYING DEVICE

TECHNICAL FIELD

The invention relates to a step support or plate support for conveying devices to tread units, thus steps or plates, with such a step support or plate support, and to conveying devices with such tread units.

BACKGROUND OF THE INVENTION

Conveying devices in the sense of the invention, which can also be termed transport devices, are escalators and moving walkways with a plurality of tread units, i.e. steps or moving walkway plates, which are connected to form an endless conveyor. Users of the conveying devices stand on the tread surfaces of the tread units or walk on the tread units in the same direction of movement as the conveying devices move or progress.

In the case of escalators, the tread units form escalator steps, hereinafter termed steps, and in the case of moving walkways the tread units form moving walkway plates, hereinafter termed plates. Escalators bridge, with a relatively large angle of inclination, greater distances in height such as entire storeys. Thereagainst, moving walkways run horizontally or at a slight inclination, but in general with smaller angles of inclination than escalators.

Typically, such conveying devices comprise drive runs constructed as step chains or plate chains. For the sake of simplicity merely drive runs are discussed in the following. These drive runs are driven in order to move the steps or plates in transport direction and, in accordance with the state of the art, they are provided at uniform spacings with so-termed step rollers or plate rollers (guide rollers, chain rollers). These guide rollers move or roll along dedicated or provided guide rails. In the region of the ends of the conveying devices the drive trains run, by the guide rollers, around deflecting wheels (or chain wheels) and thus execute a change in direction. Slide elements can also be used instead of drag rollers. The slide elements or the rollable elements (guide rollers) are directly fastened to a step chain or plate chain serving as drive run, as described further above.

In addition to the step chains or plate chains inclusive of the slide elements or rollable elements fastened thereto two further rollers, which are termed drag rollers and roll along separate guide rails, are required for each step or plate.

The steps or plates have in the past been relatively complicated to produce or cast and also expensive, since they have to be intrinsically very stable and torsionally stiff. Moreover, the steps or plates have to be made with a high degree of accuracy in order to guarantee safe, quite and jerk-free running. An essential element of each step or each plate is the step support or plate support, which has a solid, essentially load-bearing function. The support has to be very stable, strong, torsionally stiff and light, which leads to a high level of material outlay or material consumption and processing costs as well as die-casting production costs.

Various proposals have already been made with regard to how the weight of the step support or plate support can be reduced.

In DE 2051802 A1 it is proposed to produce the step support from foamed plastics material. This is indeed light, but not stable and also not durable in the long term.

According to GB 2216825 the plate support consists of a frame of four metal angle irons, within which three angle strips are provided. Provided for steps are only the three angle strips together with two step cheeks. These metal angle irons or metal strips are thick and thus heavy.

In addition, according to JP 08-245152 A two cross members in the form of solid metal angle irons, which co-operate with step cheeks, are provided as step support.

DD 69443 relates to a step for escalators in which side cheeks are integrally connected with a front part. The front part is then covered by a riser element. A tread plate serving as support for a tread element rests on this angled element. Overall, a very much more solid plate is thus employed here.

Finally, a support consisting of solid metal angle irons is also described in JP 10-45365.

The wish exists, particularly for more economic initial equipping of conveying devices, to replace the steps and plates by improved components without in that case, however, impairing running smoothness, travel characteristics, stability, robustness and reliability as well as stability. Moreover, the production process shall be simplified and accelerated. Beyond that, there shall be no increase in weight, so as not to thereby prejudice running characteristics.

BRIEF SUMMARY OF THE INVENTION

Technical Object

It is therefore the object of the invention

- to create a more economic step support or plate support for a conveying device of the kind stated in the introduction, which, however, nevertheless satisfies all demands or demand profiles and enables safe, quiet and jerk-free running, is not susceptible to failure and guarantees a long running time or high service life, the material use or material consumption additionally being as small as possible;
- to create a more economic conveying device of the kind stated in the introduction, which makes safe, quiet and jerk-free running possible, is not susceptible to failure and guarantees a high service life or long running time.

Technical Solution

According to the invention this object is fulfilled a support for a step or plate having cross members and step cheeks at ends of the cross members perpendicular to the cross members, the cross members being of sheet metal and joined to the cheeks to form a load bearing frame. The center height of each cross member is greater than the height of the cross member at its end, such that the cross member has a bulged shape.

A step support (step support structure, step support frame) or plate support according to the invention is arranged substantially below a tread element and, in the case of a step, also behind a riser element. The step support or plate support comprises a front cross member and a rear cross member or a rear cross bridge, which together define or establish a plane for reception of a tread element. The tread element serves as tread step or tread plate for passengers or travellers who are transported by the conveying device. Two outer step cheeks or plate cheeks are provided at the step support or plate support, wherein one of the step cheeks or plate cheeks is arranged on the right and one of the step cheeks or plate cheeks on the left substantially perpendicularly to the cross members. A centre longitudinal strut (centre member or centre strut or tension strut) can be provided, which extends substantially parallel to the step cheeks or plate cheeks and perpendicularly to the two cross members. The longitudinal strut connects the two cross members. According to the invention the cross members are made of deep-drawn sheet metal and welded or connected or riveted or screw-connected or clinched or adhesively bonded to the step cheeks or plate cheeks to form a load-bearing frame. Moreover, the height of the cross members at the ends thereof is smaller than the height of the cross members in the centre, so that the cross members have a bulged shape.

Advantageous Effects

In this manner the mechanical stability is highest in the centre, where it is used most, and weight is saved, by the lower height, at the edge where less mechanical stability is needed. In this manner, a stability can be achieved which approaches the stability of the known thick and heavy sheet metal angle irons, even with relatively thin deep-drawn sheet metal, although the weight is substantially less.

BRIEF DESCRIPTION OF THE DRAWINGS

The invention is explained in the following by way of examples and with reference to the drawings, in which:

FIG. 6C shows a perspective view of the deep-drawn sheet metal of a step cheek according to the invention, from the inside, after elements of the step cheek have been welded on;

FIG. 7A shows a perspective view of the deep-drawn riser element of a step according to the invention, from the inside, after fastening elements have been welded on or glued in place or plugged in;

FIG. 7B shows a perspective view of the deep-drawn tread element of a step or plate according to the invention, from the below, after fastening elements have been welded on or glued in place or plugged in;

DETAILED DESCRIPTION OF THE INVENTION

Figure 1:
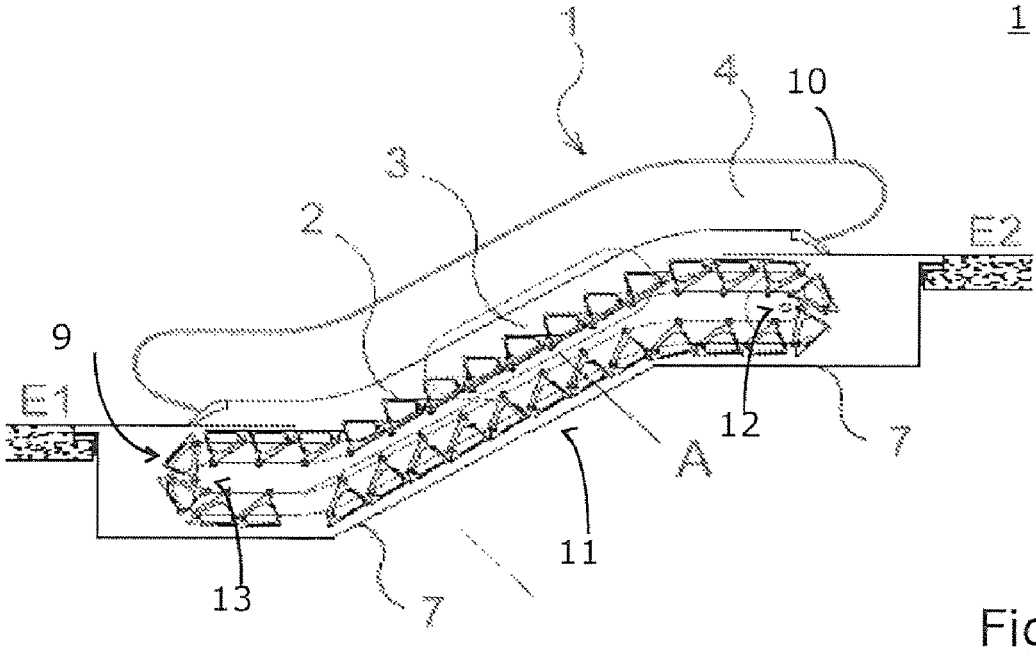
FIG. 1 shows a conveying device in the form of an escalator, in a side view, partly sectioned.

The conveying device 1 illustrated in FIG. 1 is an escalator which connects a lower level 1 with an upper level E2. The conveying device 1 comprises lateral balustrades 4 and base plates 3 and an endless conveyor with drive runs. Typically, two conveyor chains or step chains 15, which extend parallel to one another, with chain rollers are used as drive runs (see FIG. 3B) in order to set the steps 2 in motion.

In addition, an endless handrail 10 is provided. The handrail 10 moves in fixed relationship or with a slight lead with respect to the drive runs or chain runs and the steps 2 or plates. The support structure or chassis is denoted by the reference numeral 7 and the base plate of the conveying device 1 is denoted by the reference numeral 3.

The endless conveyor of the conveying device 1 substantially comprises a plurality of tread units (steps 2), as well as the two laterally arranged drive runs or step chains 15, between which the steps 2 are arranged and with which the steps 2 are mechanically connected. Additionally and further the endless conveyor comprises a drive (not illustrated) as well as upper deflecting means 12 and lower deflecting means 13, which are disposed in the upper end region and lower end region, respectively, of the conveying device 1. The steps 2 have tread elements 9 (tread surfaces).

As indicated in FIG. 1, the steps 2 run from the lower deflecting means 13, which is disposed in the region of the lower level E1, obliquely upwardly to the upper deflection means 12, which is disposed in the region of the upper level E2. This region leading from the lower deflecting means 13 to the upper deflecting means 12 is termed conveying region or forward running region of the conveying device 1 in the following, since in this region the tread surfaces 9 of the steps 2 face upwardly and thus can accept and convey persons. The return guidance of the steps 2 from the upper deflecting means to the lower deflecting means 13 takes place in a return guidance region which is here termed return running region 11. This return running region 11 is disposed below the mentioned forward running region. During the return guidance, i.e. in the return running region 11, the steps 2 with the tread surfaces 9 "hang" downwardly.

Figure 2:
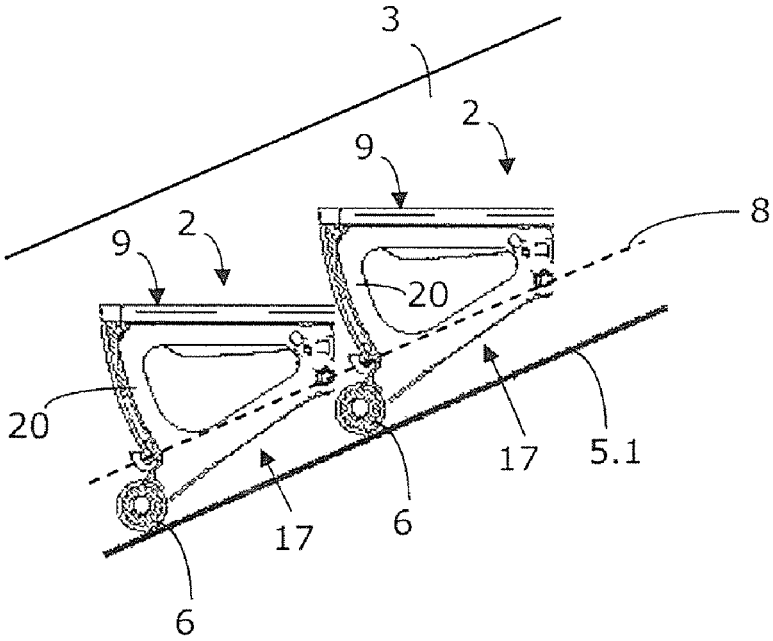
FIG. 2 shows a part region A of the conveying device according to FIG. 1 in an enlarged view.
Figure 3A:
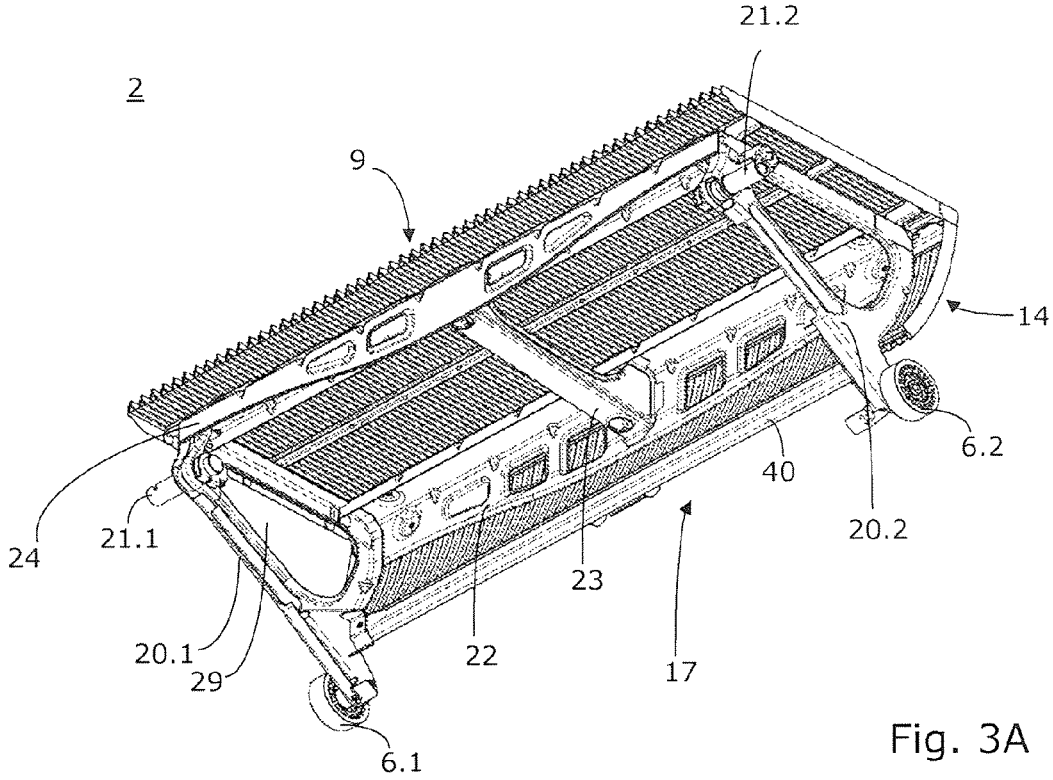
FIG. 3A shows a perspective view of a complete step with a step support according to the invention, from below.
Figure 3B:
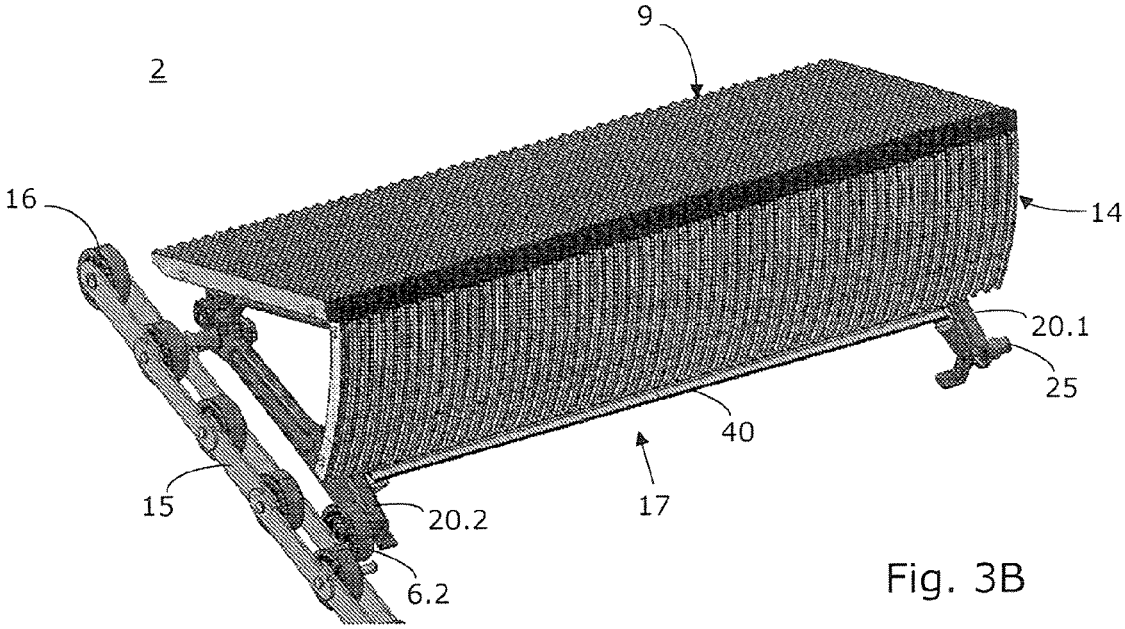
FIG. 3B shows a perspective view of a complete step with a step support according

According to a first form of embodiment of the invention, which is shown in more detail in FIGS. 2 and 3A, use is now made of steps 2 which comprise, instead of the usual step support, a step support 17 of deep-drawn elements. Examples of a corresponding step support 17 are evident from FIGS. 3A to 7B.

The support or step support 17 comprises, inter alia, two lateral step cheeks 20 with guide rollers 6 (also termed drag rollers) fastened thereto. These drag rollers 6 are mechanically connected with the respective step cheeks 20 and so constructed that in the forward running region they travel or roll along a first guide rail 5.1 when the endless conveyor of the conveying device 1 is in motion, as can be seen in FIG. 1. The first guide rails 5.1 are, in the present connection, also termed forward running guide rails so as to emphasise the function thereof. The course or position of the step chain 15 with the chain rollers 16 (not shown in FIG. 2) disposed thereat is only indicated, by the line 8, in FIG. 2. Details with respect to the arrangement of the step chain 15 and the chain rollers 16 disposed thereat are evident in FIG. 3B. The tread element 9 and the riser element 14 are particularly readily apparent in this illustration.

Figure 4A:
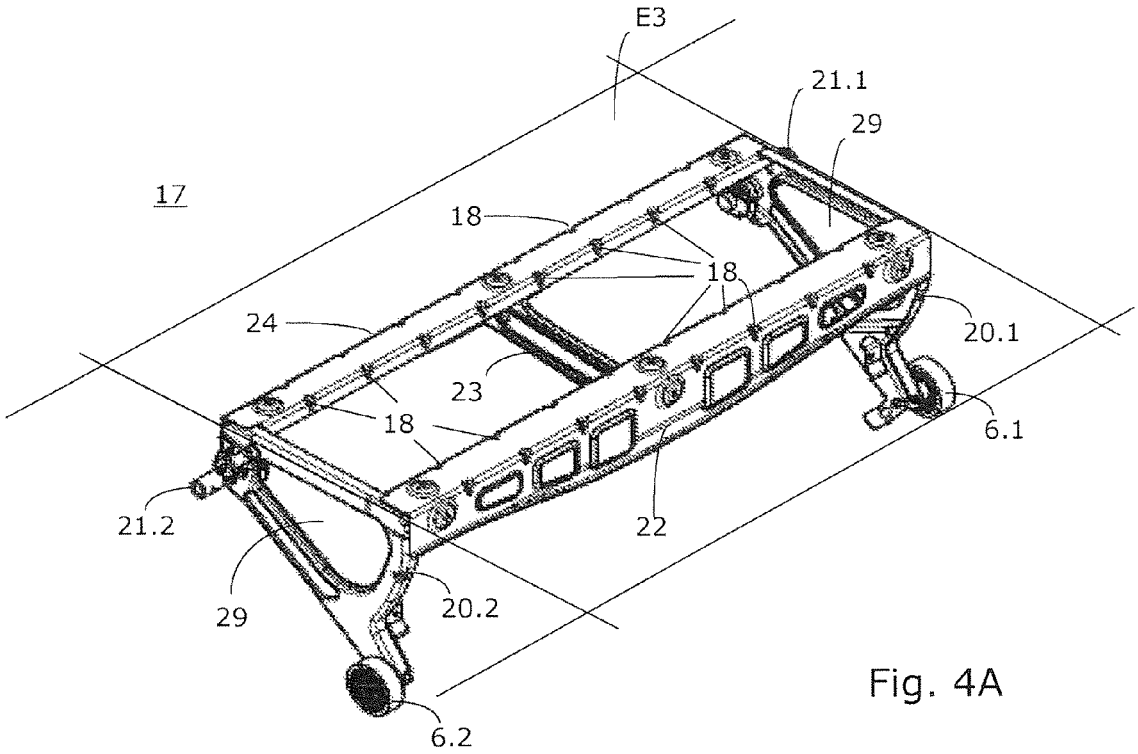
FIG. 4A shows a perspective view of the step support of a step obliquely from behind and above.

Further details and specifics of the invention are now described in connection with the following figures. A perspective view of a complete support or step support 17 according to the invention inclusive of the two lateral step cheeks 20.1, 20.2 is illustrated in FIG. 4A. As seen in travel direction, when the steps 2 move from the level E1 to the level E2 the step cheek 20.1 is arranged on the right and the step cheek 20.2 on the left of the tread element 9. Each step cheek 20.1, 20.2 has a drag roller 6.1, 6.2 and a chain axle or chain pin axle 21.1, 21.2. At least one central recess 29, thus a passage, is present in each of the step cheeks 20.1 and 20.2. In addition, each step cheek 20.1 or 20.2 has a sheet metal border 26 (sheet metal collar, sheet metal wall, sheet metal edge), which is formed during the deep-drawing (see, for example. FIGS. 6A to 6D). This sheet metal border 26 extends substantially perpendicularly to the surface of the step cheek 20.1 as well as the step cheek 20.2. The sheet metal border 26 does not necessarily have to run around the entire step cheek 20.1 or 20.2. It can also be present only partly or only in sections. The encircling sheet metal border 26 can be seen clearly in FIGS. 6B and 6D.

Further details of the step support 17 of the step 2 can be seen in FIG. 4A. The step support 17 also comprises, for example—apart from the mentioned step cheeks 20.1 and 20.2—a front cross member 24, a rear cross member 22 and a centre longitudinal member 23 (middle member or centre member). These members 22, 23, 24 can, in accordance with the invention, also be made from deep-drawn sheet metal. The members and the step cheeks together form the support of the step or the so-termed support structure or support frame.

Figure 7A:
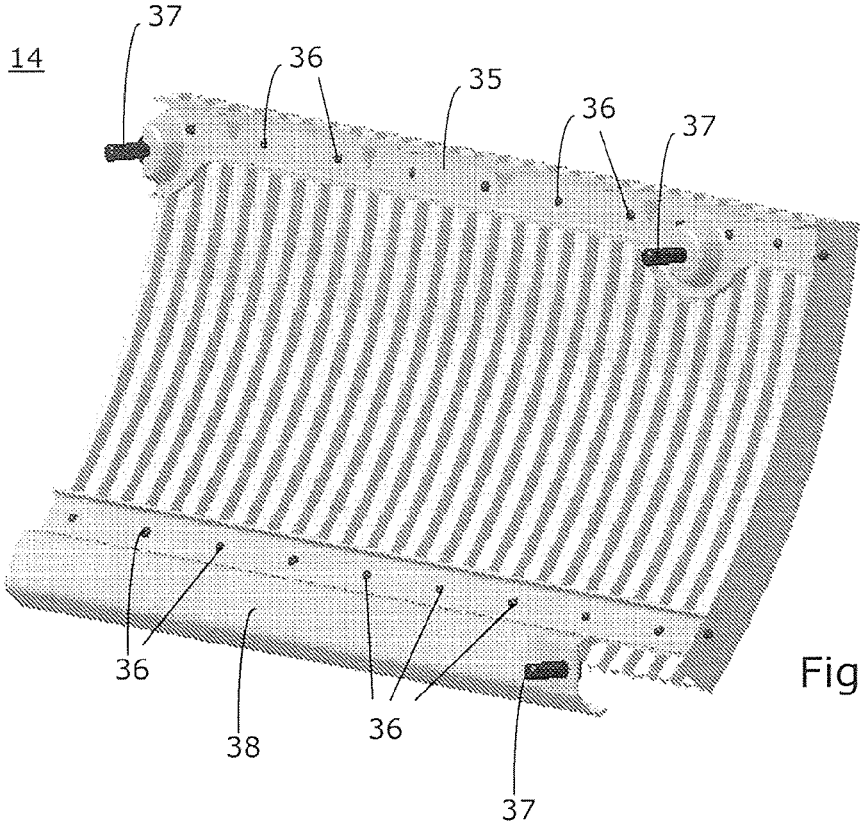
Figure 7B:
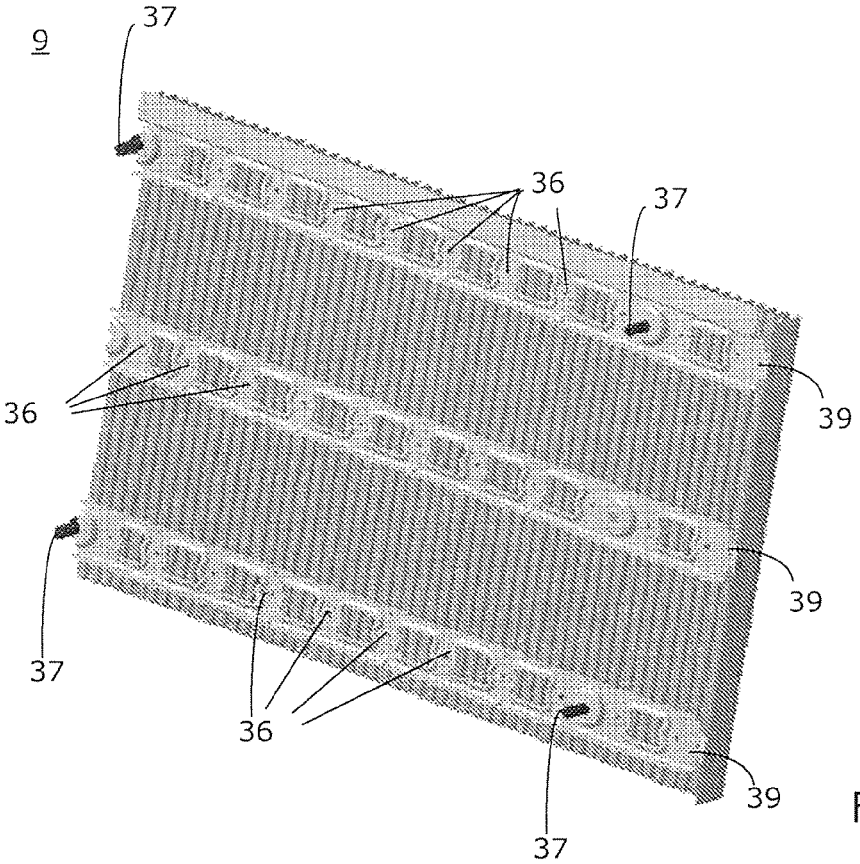

The tread element 9 and the riser element 14 are fastened at or on the step support 17. One possibility for fastening these elements 9 and 14 is shown in FIGS. 7A and 7B.

The members 22, 23, 24 and the step cheeks 20.1, 20.2 are welded or riveted or connected or screw-connected or glued or clinched together. Spot welding or projection welding is preferably undertaken in order to connect these elements with one another. Another advantage of the invention is evident here: since the step cheeks 20.1, 20.2 are made of sheet metal or steel sheet or stainless steel sheet or zinc sheet or copper sheet they can be welded or riveted or connected or screw-connected or glued or clinched to other sheet metal elements (for example the members 22, 23, 24) without problems. In addition, the use of hot-dip galvanised or electrolytically galvanised plates with spot welds or projection welds is possible, since the surface corrosion protection is not damaged during welding. The welding or casting or die-casting of aluminium elements, thereagainst, is costly and involved as well as time-consuming. The joining together of the elements of a step support by means of screws as is undertaken in part, is very involved and does not offer the desired long-term stability or durability or torsional stiffness.

Figure 4B:
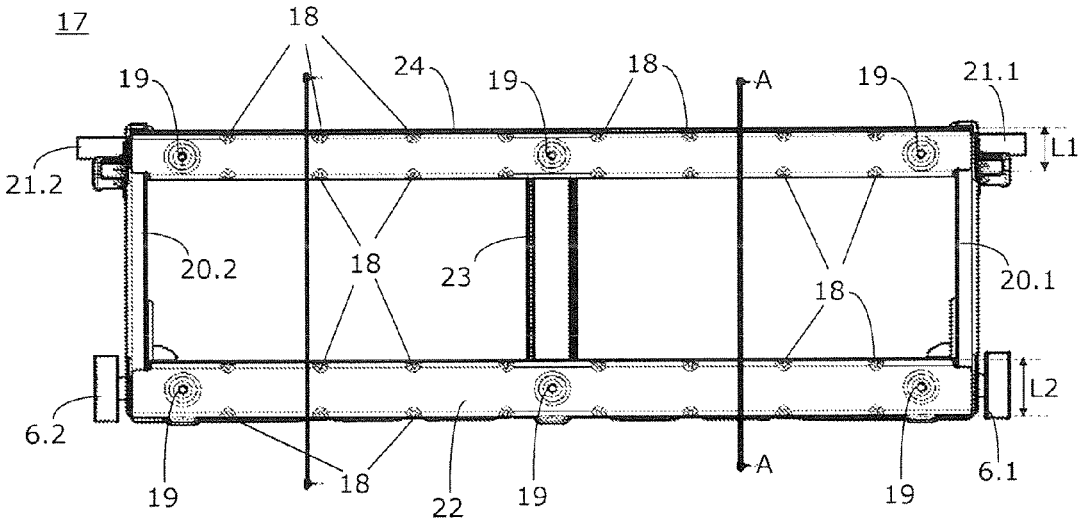
FIG. 4B shows a plan view of the support or step support of a step or plate.

The plan view of a support or step support 17 is shown in FIG. 4B. The members 22 and 24 span a plane E3 (see also FIG. 4A). In FIG. 4B the plane E3 lies in the plane of the drawing. The two members 22 and 24 extend in this plane E3 parallel to one another. A middle longitudinal member (middle member or centre member) 23 as tension strut is welded in place or riveted or connected or screw-connected or adhesively bonded or clinched centrally between the two members 22 and 24. It can be readily seen in FIG. 4B that the members 22 and 24 are provided with a row of relief notches 18 in order to reduce stress concentration in the case of dynamic loading. These relief notches 18 are disposed in the kink region of the members 22 and 24.

In addition, so-termed fastening regions 19 are provided. Islands or towers are formed in the fastening regions 19 in the sheet metal or steel sheet or stainless steel sheet or zinc sheet or copper sheet of the members 22, 24 and are raised slightly relative to the surrounding sheet metal material. A respective hole enabling plugging through of a fastening pin or plug pin 37 (see also FIGS. 7A and 7B) is provided centrally in each of these fastening regions 19. The tread element 9 is fastened to the members 22, 24 and the riser element 14 is fastened to the rear cross members 22 and a bracket 40 by the fastening pins or plug pins 37 (see FIG. 3B).

Figure 4C:
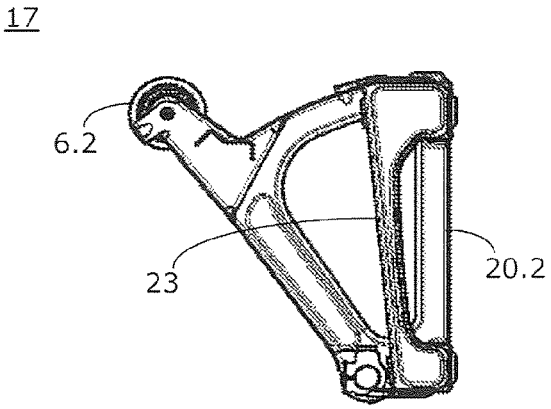
FIG. 4C shows a (centre) sectional view of a step support according to the invention.

A sectional view along the line A-A in FIG. 4B is shown in FIG. 4C. On the one hand the inner side of the step cheek or cheek 20.2 and on the other hand a side of the centre longitudinal member 23 (middle member or centre member) can be seen in this FIG. 40. The longitudinal member 23 (middle member or centre member) forms a 'C section', the opening of which faces upwardly, i.e. the actual longitudinal member is offset somewhat downwardly relative to the plane E3.

Figure 4D:
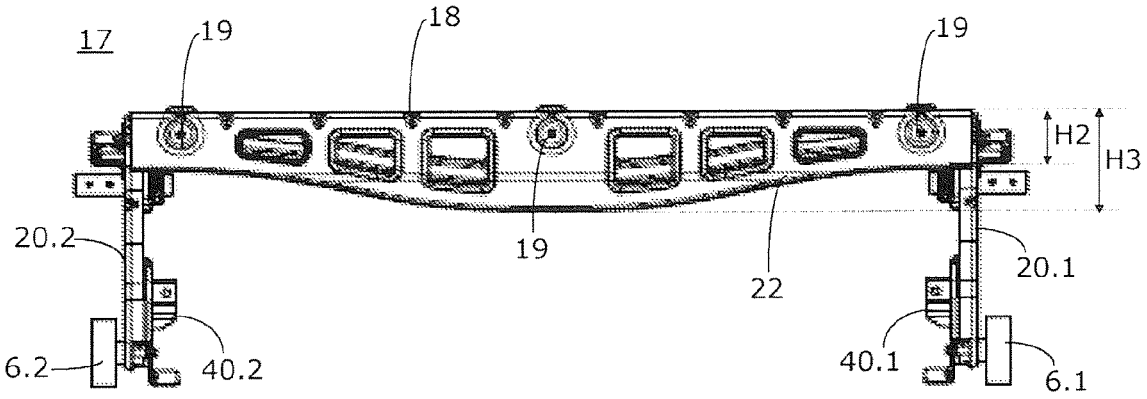
FIG. 4D shows a rear view of a step support according to the invention.

FIG. 4D shows a front view of the step support 17. The lateral step cheeks 20.1, 20.2, which are perpendicular with respect to the cross members 22, 24 or the plane E3, can be seen in this view. Three fastening regions 19 can be seen in FIG. 4D. The riser element 14 is fastened at these three fastening regions 19. The riser element 14 is fastened to a bracket 40 at the lower edge. The bracket 40 extends between the two step cheeks or cheeks 20.1, 20.2 and is held there by the fastening plates or brackets 40.1, 40.2.

In departure from previous step supports, according to the invention use is made of elements (for example the members 22, 23, 24 and the step cheeks 20.1, 20.2) having a shape and thickness adapted to the respective mechanical loads. In the past, for example, the cross members 22, 23 of the step support, which in part are also termed transverse bridges, had a simple cross-sectional profile with a constant cross-section over the entire length (say step width). According to the invention the cross members 22 and 24 are exactly and precisely matched to the loads which arise, whereby material is saved to a large extent.

Figure 5A:
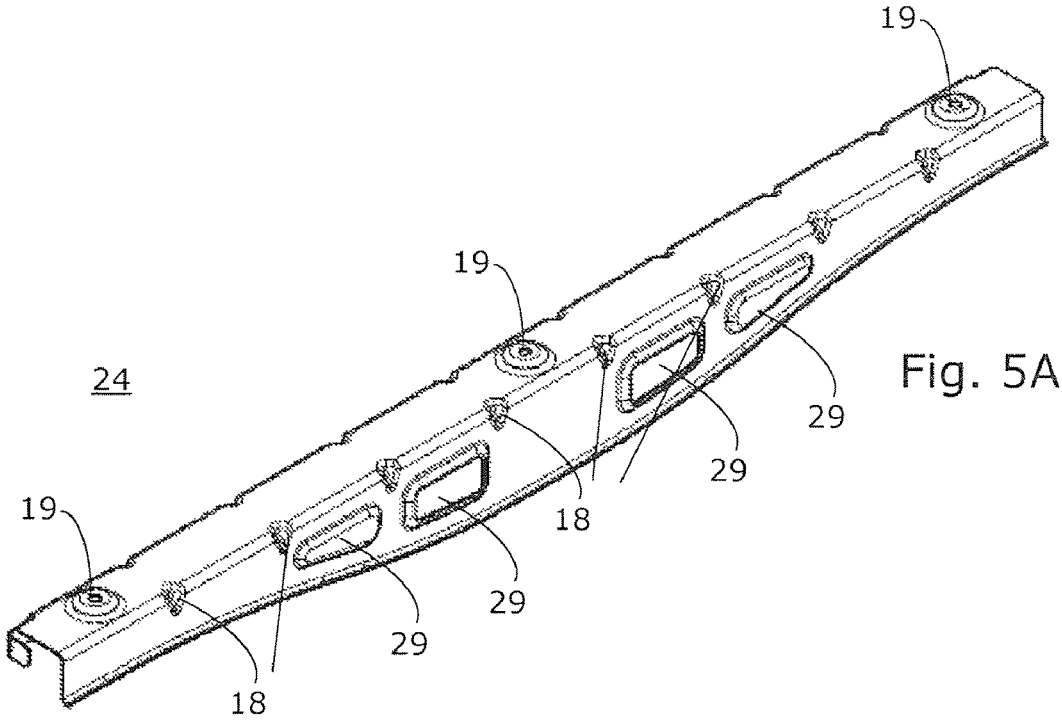
FIG. 5A shows a perspective view of the front cross member, which is made of deep-drawn sheet metal, of a step support according to the invention.
Figure 5B:
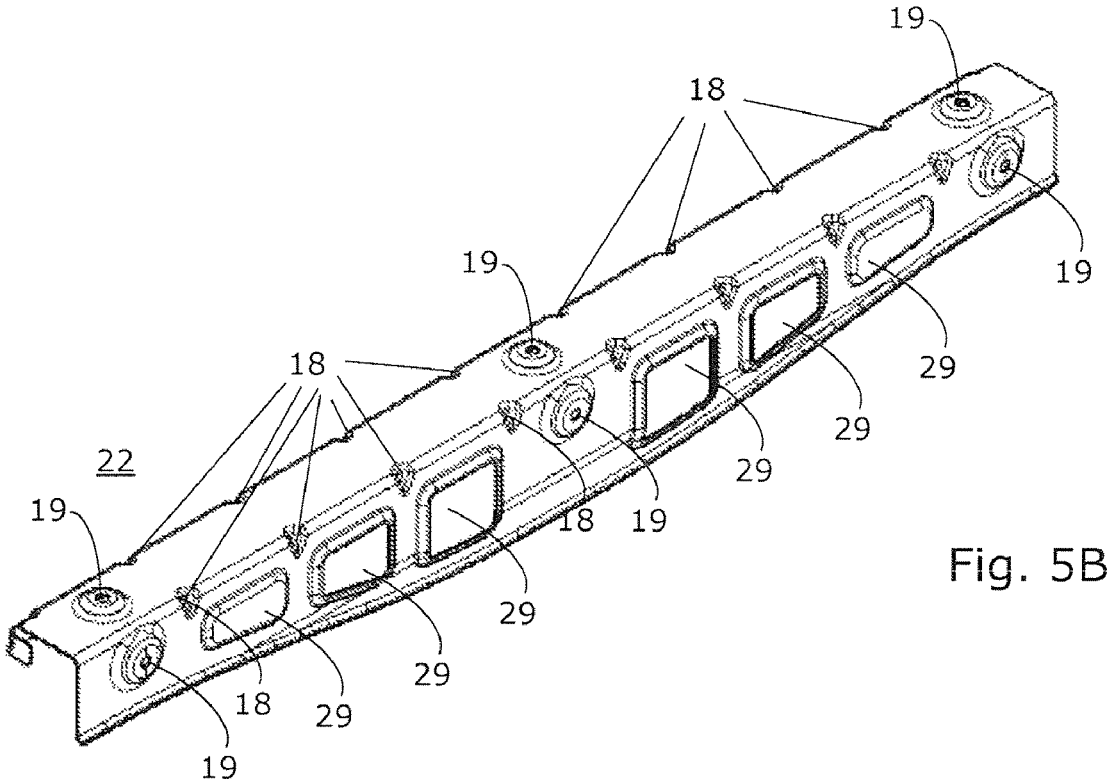
FIG. 5B shows a perspective view of the rear cross member or cross bridge, which is made of deep-drawn sheet metal, of a step support according to the invention.

In FIGS. 5A and 5B it can be seen, for example, that both cross members 22, 24 have a height which increases towards the centre. Thereagainst, the height is significantly lower at the two distal ends. In a case of the member 24, for example, the height H2 at the side is significantly smaller than the height H3 at the centre (see FIG. 4D), wherein H3 can be almost twice as large as H2. The members 22, 24 have, stated in other words, a downwardly pointing bulged shape. Through this shape account is taken of the fact that the mechanical loads are greatest in the centre of the step 2 or the plate. Moreover, a constant force flow is made possible by this bulged shape and the stresses can be accepted uniformly or constantly. Beyond that, the cross members 22, 24 are constructed as 'members of equal strength'. Consequently, a constant stress course and a constant or uniform stress in the cross member 22 and in the cross member 24 result.

The positive advantages achieved by the present invention were mathematically proven and confirmed by Finite Element Method (FEM) simulations on a computer.

Figure 9:
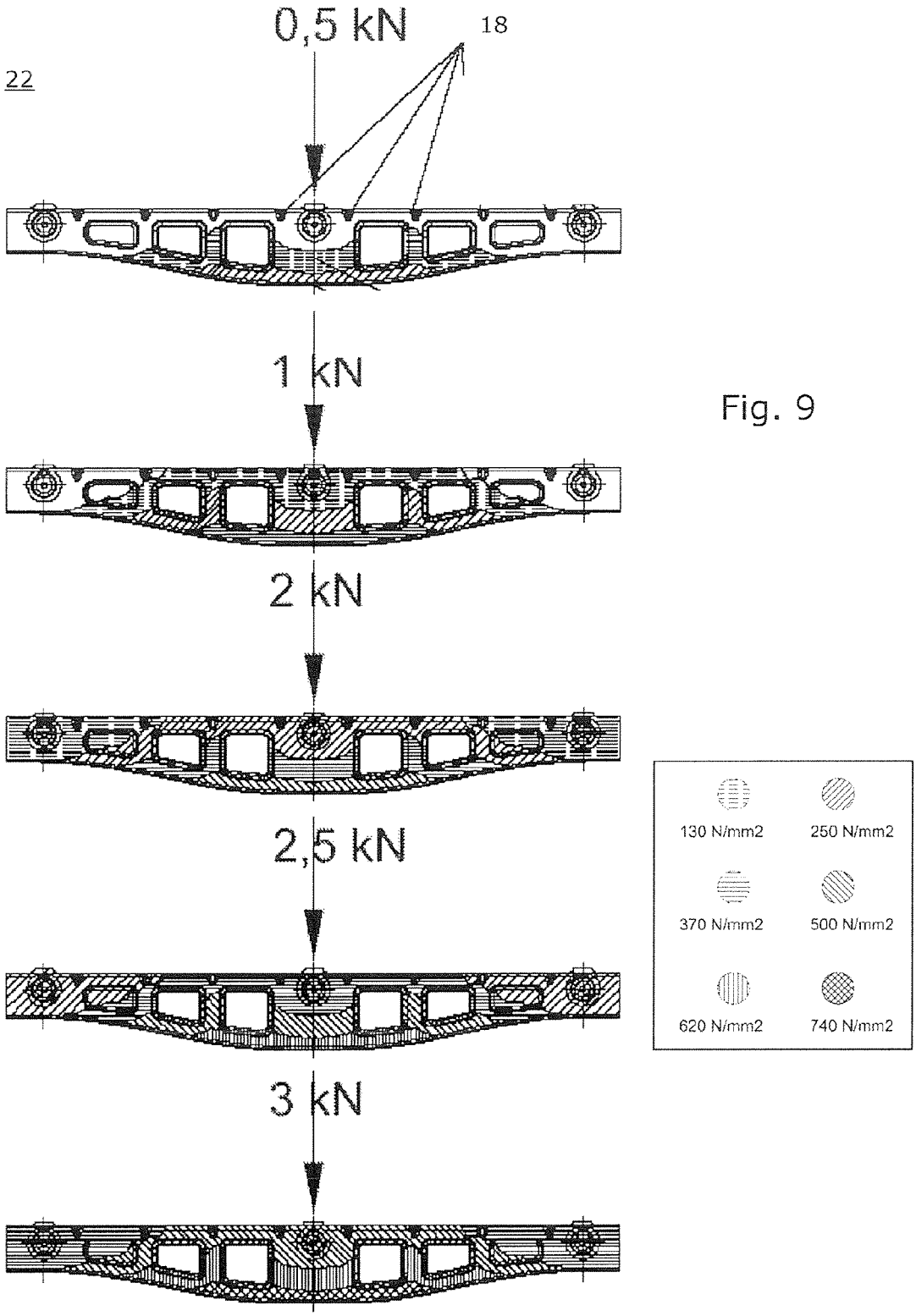
FIG. 9 shows the calculations of the stresses in the step support under different loadings of the step.
Figure 10:
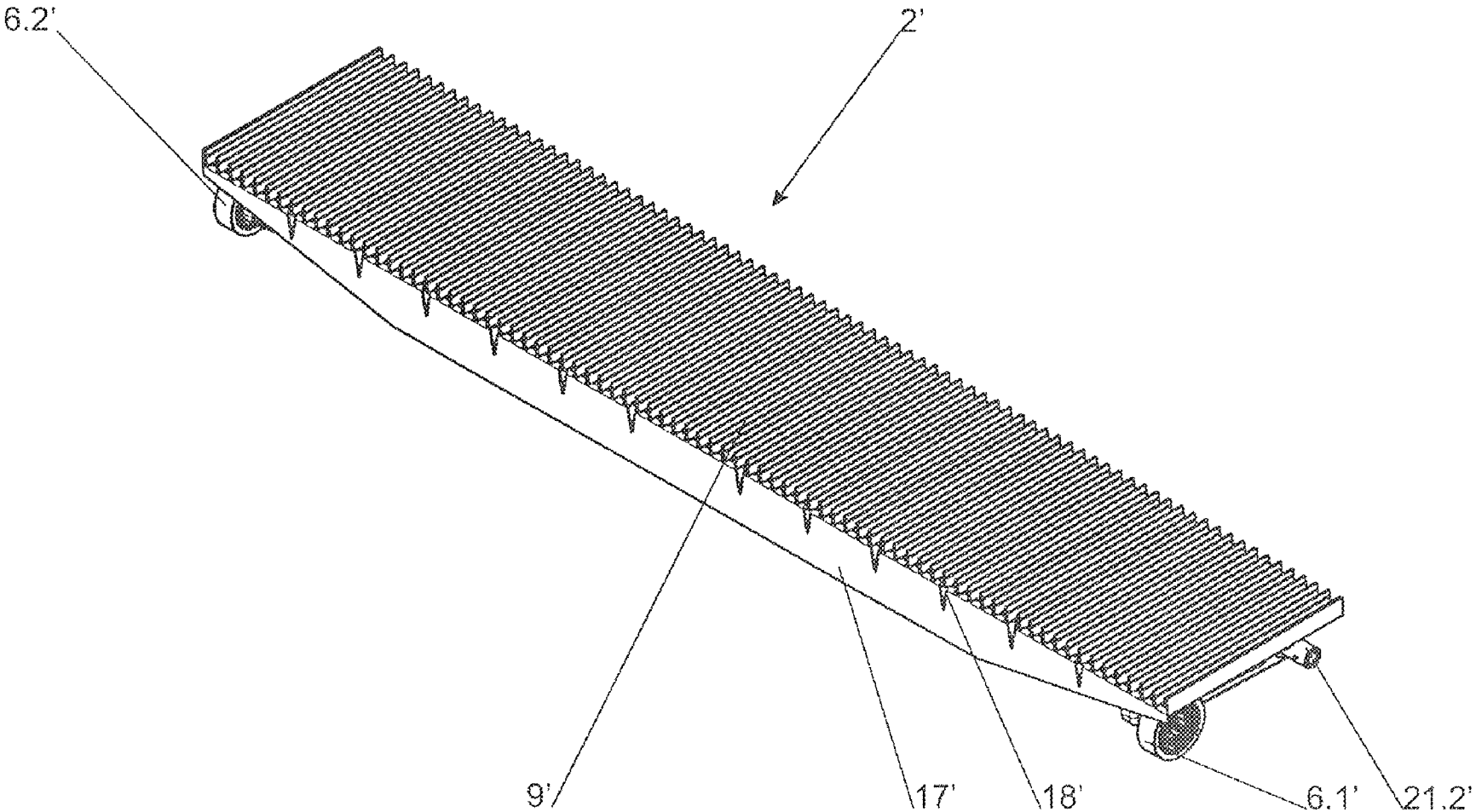
FIG. 10 shows a perspective view of a complete plate with a step support according to the invention, from above.

FIG. 9 shows the stresses which were calculated by FEM simulations and which form in the rear cross member 22 when the escalator step 2 is loaded by 0.5 kN or 1 kN, 2 kN, 2.5 kN and 3 kN (illustration from above to below).

The values of the stresses are indicated in FIG. 9 by different hatchings, the significance of which is indicated in the drawing explanation in FIG. 9 at the bottom on the right.

It is apparent from FIG. 9 that the stresses under each loading of the step 2 attain their maximum values in the downwardly facing bulge of the rear cross member 22.

In this region, however, the stresses never exceed the value 740 N/mm$^2$, even when the step is loaded by 3 kN (see FIG. 9 at the bottom). This value lies below the breaking point of steel. The step thus satisfies safety standards notwithstanding the thinness of the sheet metal employed.

Considered from the side, i.e. in cross-section, the two members 22, 24 have substantially an L shape, wherein one limb of the L profile lies in the plane E3 and the second limb lies in a plane perpendicular thereto.

Members 22, 24 having an asymmetrical U shape are particularly preferred, wherein one lateral limb of the U profile is substantially shorter and the other, longer limb has the described bulged shape.

Both L-shaped and U-shaped sections can be produced without problem by deep-drawing. During deep-drawing a hollow body or a body or a member or a hollow member or a bridge with a sheet metal thickness as constant as possible is produced from the flat sheet metal cross-section (for example sheet metal from a steel coil).

The front cross member 24 is preferably dimensioned to be less large than the rear cross member 22, since the rear cross member 22 is arranged in the region of the step edge (edge between tread element 9 and riser element 14) and is exposed at that point to strong loads, i.e. stronger loads than the front cross member 24. Amongst other things, the length L1 is less than the length L2 (see FIG. 4B), wherein the length is measured in travel direction. The front cross member 24 is, for reasons of weight optimisation or material efficiency, dimensioned to be smaller or constructed to be smaller than the rear cross member 22. A saving of material and a minimum weight are thereby achieved. Consequently, a weight-optimised and stress-optimised dimensioning of the cross members 22, 24 or of the support is feasible and achievable in the best possible manner.

Figure 5C:
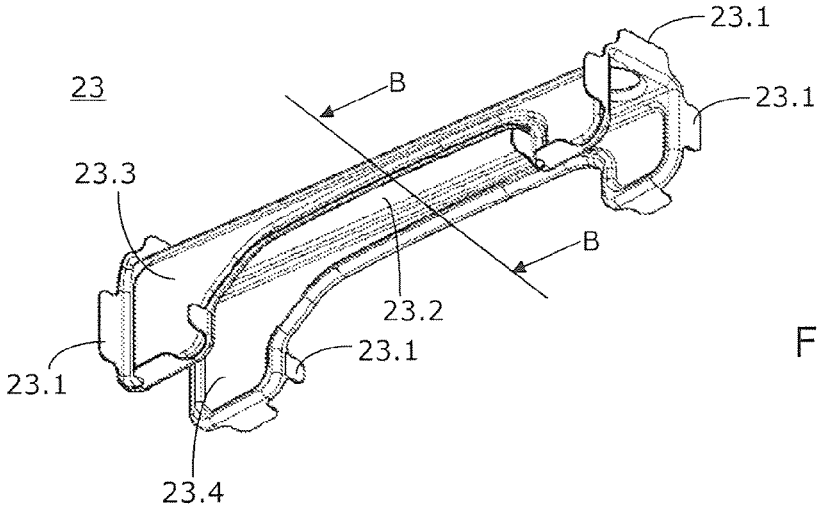
FIG. 5C shows a perspective view of the centre longitudinal member, which is made of deep-drawn sheet metal, of a step support according to the invention.

The centre longitudinal member 23 (middle member or centre member or tension strut or centre strut) is shown in FIG. 5C. The longitudinal member 23 has the form of a flattened C section, wherein the two lateral limbs can be of equal length or equal height. Considered in cross-section, i.e. in a sectional plane B-B extending parallel to one of the cross members 22, 24, the longitudinal member 23 has a symmetrical U shape. The lateral limbs 23.3 and 23.4 of the U section have a different length or height depending on the respective position of the sectional plane and are optimised in weight. Straps 23.1, which are bent outwardly or inwardly, are preferably provided in the two end regions of the longitudinal member 23. These numerous different straps 23.1 make it possible to weld in place or rivet or screw in place or glue or fixedly clinch the longitudinal member 23 at the inside in the cross members 22, 24 without problems. Some of these straps 23.1 are provided in FIG. 5C with reference numerals.

When the step support 17 is assembled and welded together or riveted together or screw-connected together or glued together or clinched together the longitudinal member 23 is installed not in the position shown in FIG. 5C, but turned around, wherein then the flat region 23.2 of the U section, which connects the two side limbs 23.3 and 23.4, faces away from the tread element 9 or from the tread surface of the step 2.

Further details or specifics of a lefthand step cheek 20.2 can be seen in FIGS. 6A to 6D. The step cheek 20.2 is 'fitted' with all elements and can be incorporated or welded in place in the shown form in the step support 17. It can be seen in FIGS. 6A and 6D that a chain pin axle 21.2 or chain roller axle is inserted or plugged in place in the region of a step eye 32 (also termed chain pin roller eye). A slide bearing bush (not able to be seen in the figures) can be pressed into the step eye 32 so as to then receive the chain pin axle 21.2. The chain pin axle 21.2 or chain roller axle is preferably a plug axle. The plug axle can be constructed with a calibrated receiving bore. The chain roller axle 21.2 or chain pin axle serves as entrainer or coupling for the step or plate to the chain or conveying chain 15 (see FIG. 3B).

The step eye 32 is entirely defined by the deep-drawn sheet metal or steel sheet or stainless steel sheet or zinc sheet or copper sheet or it is entirely surrounded by the sheet metal.

Moreover, the step cheek 20.2 has a drag roller eye 30. Here, too, a slide bearing bush can be pressed in place (see FIG. 6D) in order to then accept a drag roller axle 25 (see FIG. 6A) or a roller pin. The drag roller axle 25 or the roller pin can be secured by a nut or welded in place or secured by weld seams. The drag roller axle 25 or the roller pin is preferably a plug axle or a plug pin. The drag roller axle 25 or the roller pin serves as an axle for the drag roller 6.2.

Figure 6A:
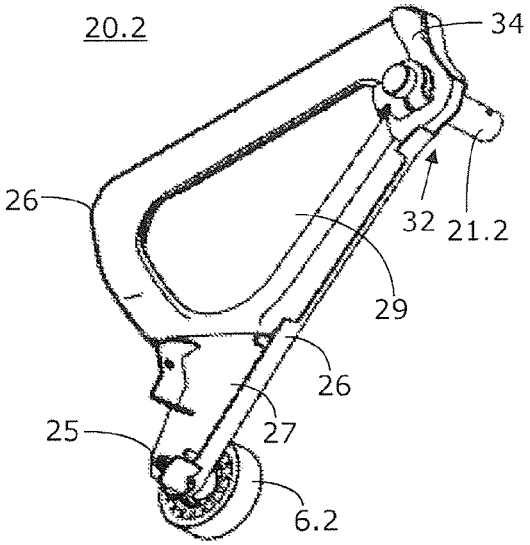
FIG. 6A shows a perspective view of a step cheek according to the invention, from the inside.
Figure 6B:
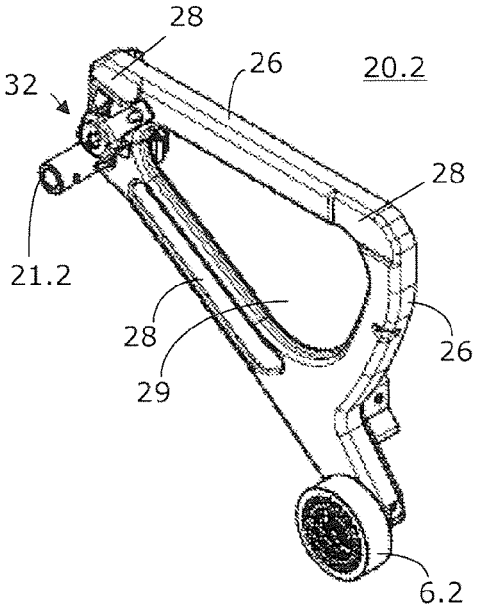
FIG. 6B shows a perspective view of a step cheek according to the invention, from the outside.
Figure 6C:
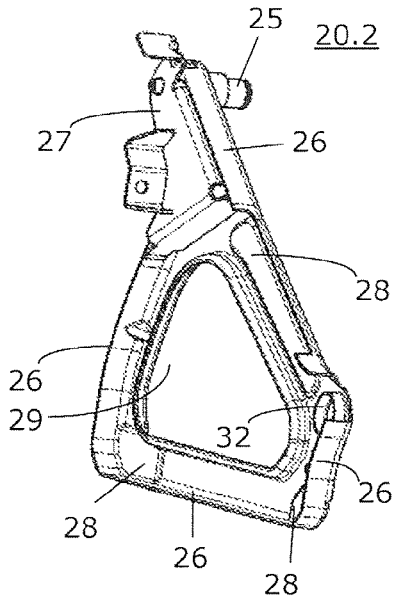
Figure 6D:
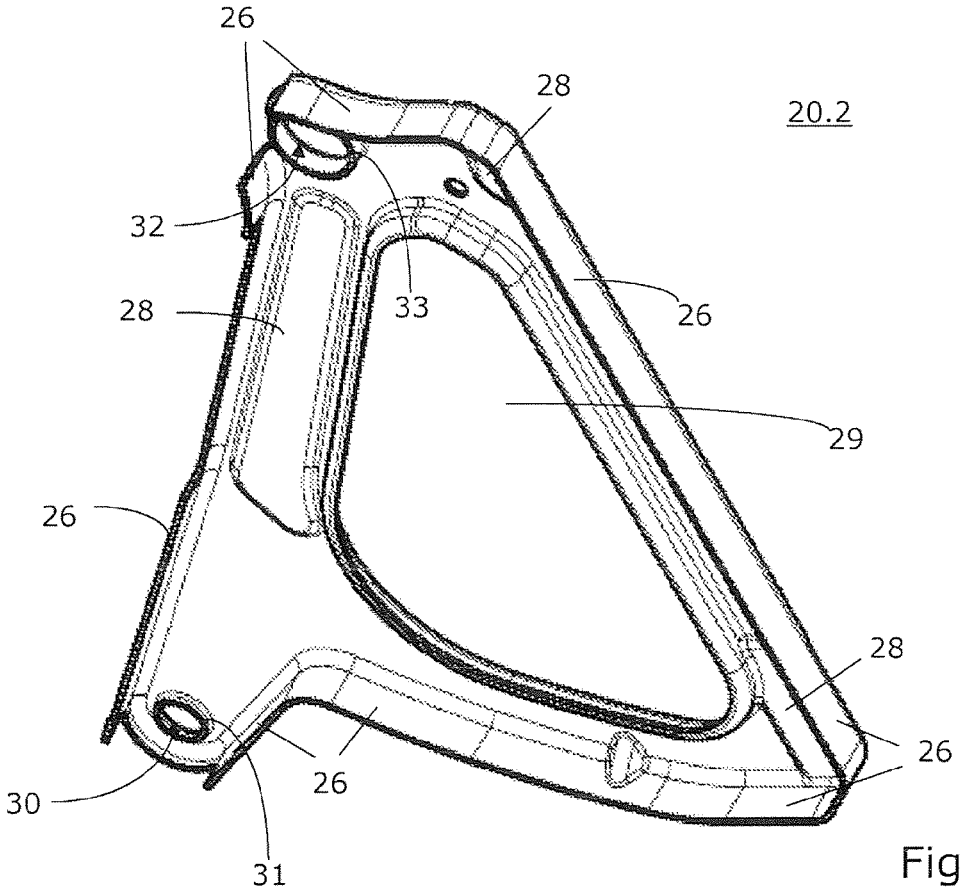
FIG. 6D shows an enlarged perspective view of the deep-drawn sheet metal of a step cheek according to the invention, from the inside.

The drag roller eye 30 is preferably also entirely defined by the deep-drawn sheet metal or it is entirely surrounded or enclosed by the sheet metal, as can be seen in, for example, FIG. 6D.

In the region of the drag roller eye 30 the step cheek 20.2 can be stiffened or supported or covered from the inside by a closure plate 27. This closure plate 27 (also termed 1st closure plate) can be welded in place in a cavity or hollow part or hollow web or step (cheek) post, which arises through to the deep-drawing. A similar, 2nd closure plate 34 can be provided in the region of the step eye 32 (see FIG. 6A). The 2nd closure plate 34 can be constructed or formed as an additional bearing receptacle.

Further details or specifics of a step cheek 20.2 according to the invention are shown in FIGS. 6C to 6D. As can be seen, the deep-drawn sheet metal is provided with the recess 29 or with the passage. This recess 29 is preferably produced, after the deep-drawing, by cutting or punching the sheet metal. In addition, the stated eyes 30 and 32 can or could be pre-punched before they receive an encircling sheet metal collar 31 or 33 by the deep-drawing. The so-termed eyes 30 and 32 are preferably produced, after the deep-drawing, by cutting or trimming or aperturing. Processing after the deep-drawing has the advantage of uniform collar thickness. This means that the eyes have or the eye has a uniform rest or bearing rest or bearing length or bearing depth or bearing width and uniform wall size or wall thickness as well as precise centricity. The encircling sheet metal collars 31 and 32 facilitate stable installation of the slide bush or slide bushes for the respective axles 21.2 and 21.1 or for the pin or for the drag roller axle 25.

Moreover, sufficient stability is imparted to the step cheek in that additional shaped portions 28 and additional beads 28 are present. The sheet metal border 26 also imparts a very high or very substantial stability to the thin deep-drawn sheet metal.

Merely one half of a riser element 14 according to the invention is shown, from behind, in FIG. 7A. The riser element 14 is preferably a sheet metal element which was brought to the desired shape by deep-drawing or preferably by twofold deep-drawing. As usual in the case of escalator steps 2 or plates, the surface of the riser element 14 has grooves and ribs which can be seen in FIG. 7A from behind. The front side of the riser element 14 with the grooves and ribs can be seen in FIG. 3B. A 1st fastening plate 35 and a 2nd fastening plate 38 are welded or fastened on the rear side of the riser element 14 in the illustrated example. Several weld points 36 and/or rivet locations and/or screws and/or glue locations and/or clinch points are preferably provided in order to mount the fastening plates 35, 38 on the rear side of the riser element 14. The respective weld points 36 or fastening points can be seen in FIG. 7A. Provided at the fastening plates 35, 38 or reinforcing plates or stiffening plates are raised fastening regions which are so arranged that during mounting they come to lie over the corresponding fastening regions 19 of the step support 17.

As can be seen in FIG. 7A, fastening pins or plug pins 37 can be plugged from behind through holes in the fastening plates 35, 38. Through welding or fastening of the fastening plates 35, 38 to the rear side of the riser element 14 these fastening pins or plug pins 37 are protected against dropping out. If, now, the riser element 14 is pressed by its rear side against the step support 17 then the fastening pins or plug pins 37 are received by holes provided in the fastening regions 19 of the step support 17. In that case the fastening pins or plug pins penetrate the holes in the fastening regions 19 of the step support 17 to such an extent that quick-action fastening means 37.1, 37.2 or other clamping washers or grip rings or fastening means 41 can be placed or pressed onto the fastening pins or plug pins 37 from the rear side (i.e. from the inside of the step support 17).

Merely one half of a tread element 9 or a tread surface according to the invention is shown, from below, in FIG. 7B. The tread element 9 or the tread surface is preferably a sheet metal element brought to the desired shape by deep-drawing. As usual with escalator steps 2 or plates, the surface of the tread element 9 or tread surface has grooves and ribs which can be seen from below in FIG. 7B. The upper side of the tread element 9 or tread surface with the grooves and ribs can be seen in FIG. 3B. Several fastening plates 39 are welded or fastened on the underside of the tread element 9 or tread surface in the illustrated example. Several weld points 36 and/or rivet locations and/or screws and/or glue locations and/or clinch points are preferably provided in order to weld or rivet or screw-connect or glue or clinch the fastening plates 39 or reinforcing plates or stiffening plates to the rear side of the tread step or tread surface 9. The respective weld points 36 or fastening points 36 can be seen in FIG. 7B. Provided at the fastening plates 39 or reinforcing plates or stiffening plates are raised fastening regions which are so arranged that during assembly they come to lie over the corresponding fastening regions of the step support 17.

As can be seen in FIG. 7B, similar or the same fastening pins or plug pins 37 can be plugged from behind through holes in the fastening plates 39. These fastening pins or plug pins 37 are protected against dropping out by the welding or fastening of the fastening plates 39 to the underside of the tread element 9 or the tread surface. If, now, the tread element or the tread surface 9 is pressed by the rear side thereof against the step support 17 then the fastening pins 37 or plug pins are received by holes provided in the fastening regions 19 of the step support 17. In that case the fastening pins or plug pins 37 penetrate the holes in the fastening regions 19 of the step support 17 to such an extent that quick-action fastening means 37.1, 37.2 or other clamping washers or grip rings or fastening means 41 can be placed or pressed onto the fastening pins 37 or plug pins from the underside (i.e. from the inside of the step support 17).

Figure 8A:
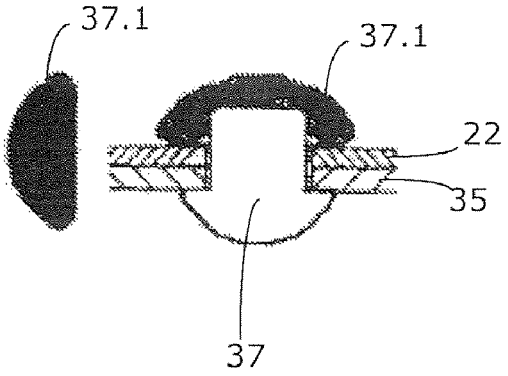
FIG. 8A shows a first quick-action fastener, which can be used.
Figure 8B:
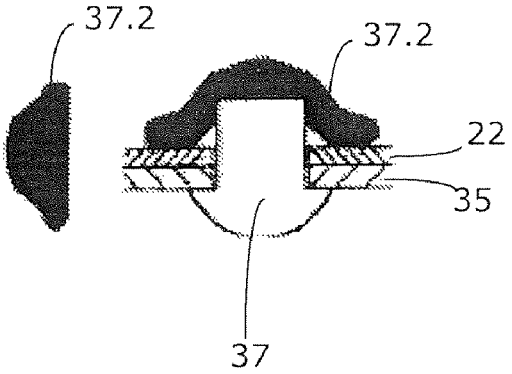
FIG. 8B shows a second quick-action fastener, which can be used.

Quick-action fastening means 37.1, 37.2 able to be used in accordance with the invention are shown in FIGS. 8A to 8D. It may be noted that the illustrations in FIG. 8A and FIG. 8B are simplified illustrations. Neither the dimensions are correctly illustrated nor do the sheet metals or steel sheets or stainless steel sheets or zinc sheets or copper sheets lie flatly on one another in the connecting region.

A pin-shaped fastening element as fastening pin 37 or plug pin is shown in FIGS. 8A and 8B. This fastening pin 37 or plug pin is plugged through holes in the two parts to be connected (for example in the 1st fastening plate 35 and in the cross member 22). A quick-acting fastening means 37.1 or 37.2 (with round or curved arching-over or cap or without cover or hood or cap) is plugged or pressed on the rear side onto the pin or fastening pin or plug pin projecting through the sheet metal of the cross member 22. The fastening plate 35 inclusive of the riser element 14, which is firmly welded or firmly riveted or firmly screw-connected or firmly glued or firmly clinched thereto, is thereby fastened to the cross member 22.

Figure 8C:
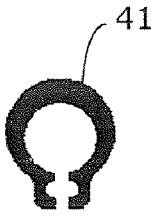
FIG. 8C shows a grip ring, which can be used.
Figure 8D:
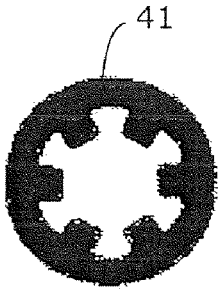
FIG. 8D shows a clamping washer, which can be used.

Further fastening means or clamping washers or grip rings 41, which can be placed or clamped on the groove-free shank of the fastening pin 37 or plug pin an as to fix the fastening pins 37 and the corresponding deep-drawn sheet metal 22, 35 are shown in FIGS. 8C and 8D. A metallic grip ring 41 is shown in FIG. 8C and a metallic clamping washer 41 is shown in FIG. 8D.

Use is preferably made of H380 or H400 deep-drawn sheet metal for parts of the step support 17, wherein the numbers 380 and 400 indicate the yield point in $N/mm^2$. These sheet metals are particularly suitable, because a yield point in tension of at least 900 $N/mm^2$ is given. Beyond that, it is particularly advantageous if the sheet metals have a yield point in tension of at least 1100 $N/mm^2$.

The deep-drawn sheet metal used preferably has a thickness between 0.75 millimeters and 1.9 millimeters. A thickness of 1.1 to 1.6 millimeters is particularly preferred.

If the deep-drawn sheet metal is selected in correspondence with the above specifications, then the step cheeks or the step or steps fulfils or fulfil all load tests of Standard EN 115: Safety Regulations for the Construction and Installation of Escalators and Moving Walkways, as well as AN—American National Standard—ASME A17.1-2004: Safety Code for Elevators and Escalators.

The deep-drawn sheet metal preferably has a surface coating. Surface coatings produced by dip-coating are particularly preferred.

Electrolytic dip-coating (EDC) is particularly suitable.

The result of EDC is a very uniform coating of the deep-drawn sheet metal with uniform layer thickness and good surface qualities. After the EDC treatment the deep-drawn sheet metal has a uniform, continuous coating layer. Particularly good results are achieved if the EDC treatment is used after deep-drawing of the sheet metal.

Use of the EDC treatment prior to the deep drawing is also conceivable. Moreover, use or employment with (pre-) galvanised sheet metals or stainless steel sheets or copper sheets is also possible.

As described, the invention can be used not only on escalators, but also on moving walkways. This is now clarified by way of FIGS. 10 to 18. Many parts of the plates for the moving walkway have correspondence with the steps for the escalator. These parts bear the same reference numerals, but with an apostrophe; thus, the tread element of the plate is denoted by the reference numeral 9', because the tread element of the step is denoted by 9. Insofar as there is correspondence with the step, the parts are not explained again.

Figure 11:
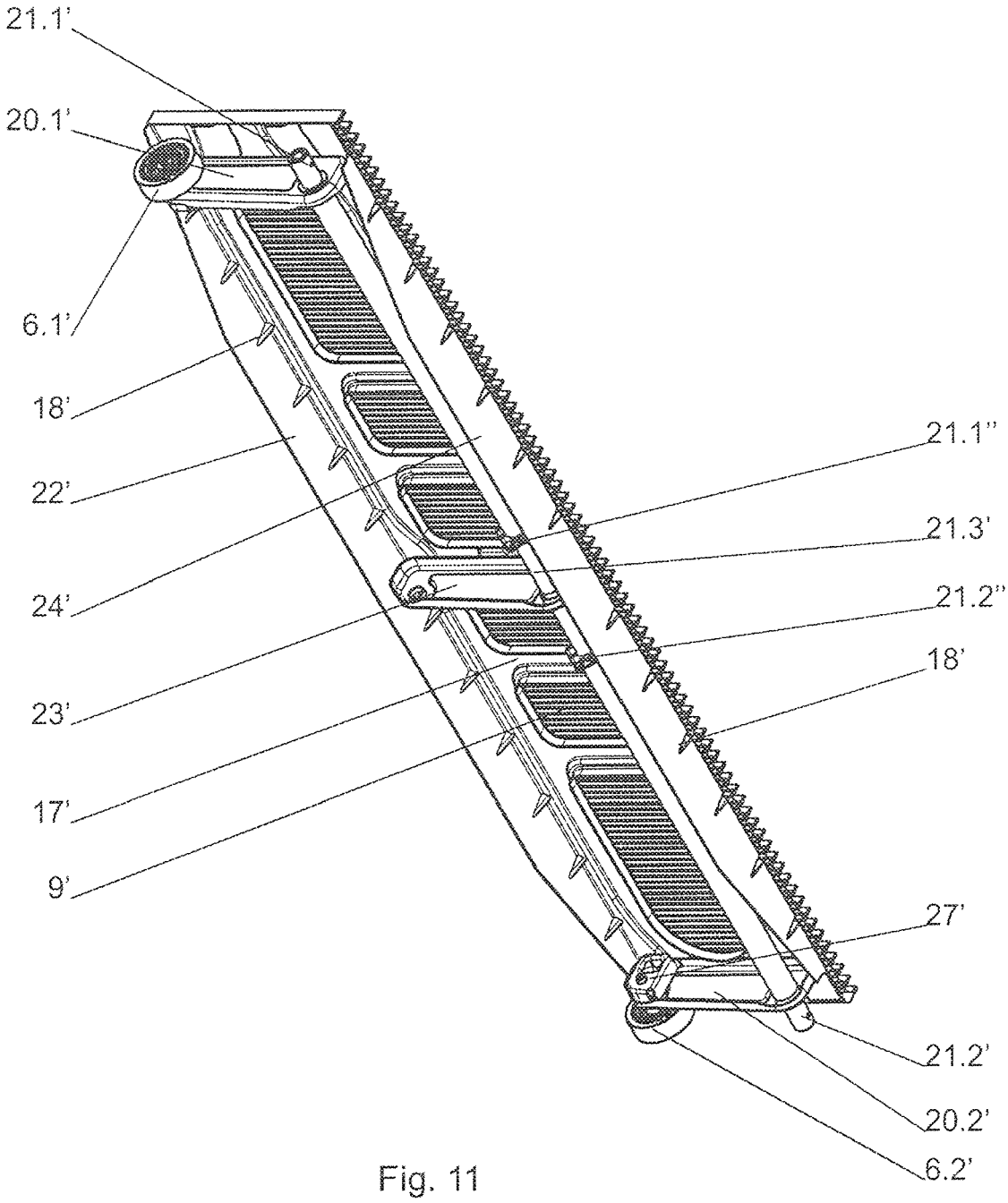
FIG. 11 shows the same in a perspective view from below.
Figure 12:
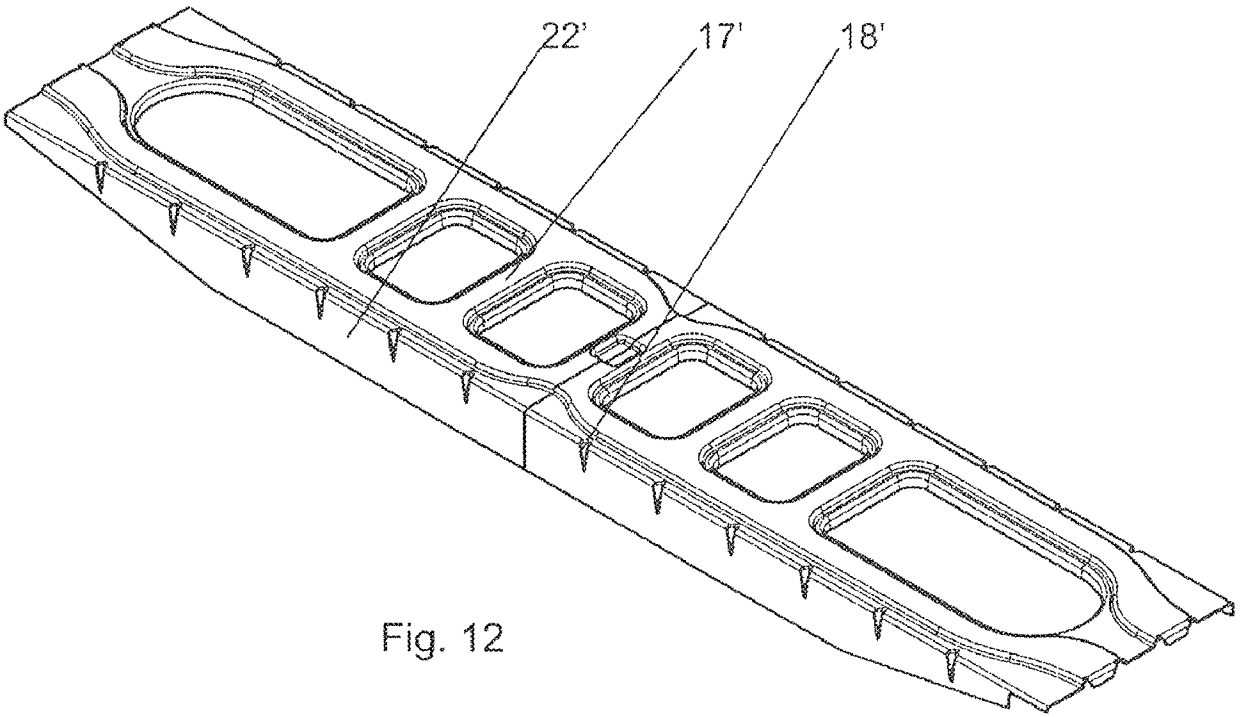
FIG. 12 shows a perspective view of the plate support of a step obliquely from above.
Figure 13:
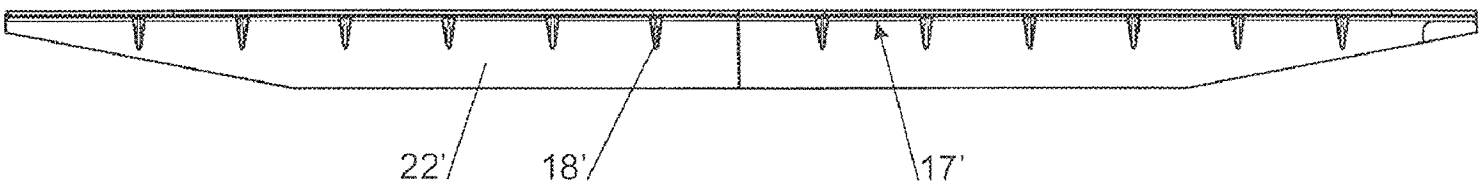
FIG. 13 shows the same, in side view.
Figure 14:
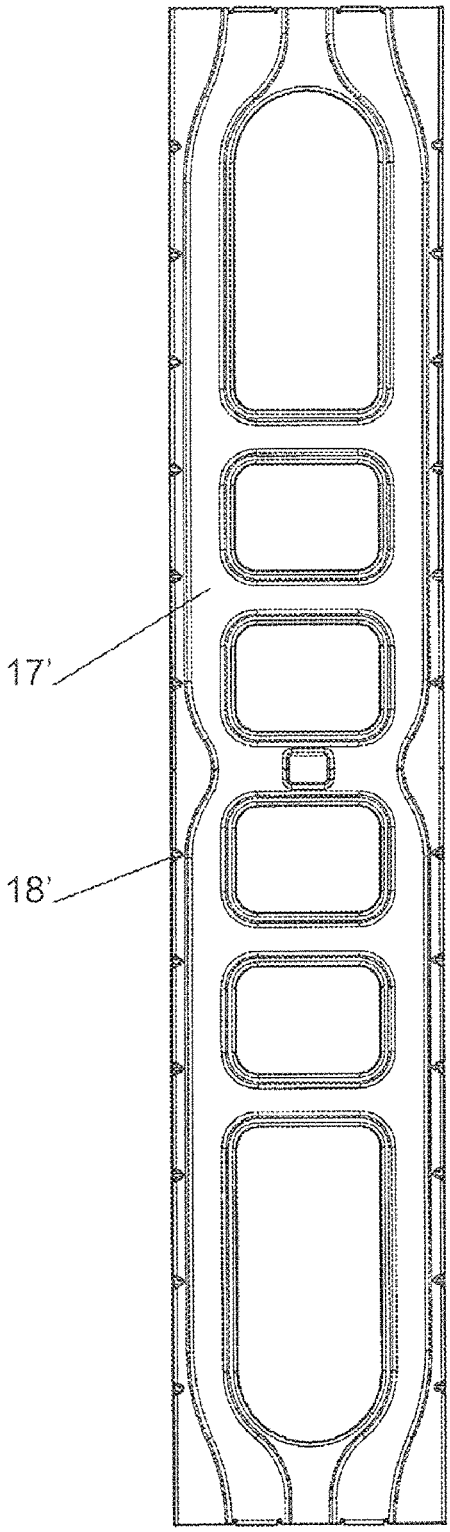
FIG. 14 shows the same, in plan view.
Figure 15:
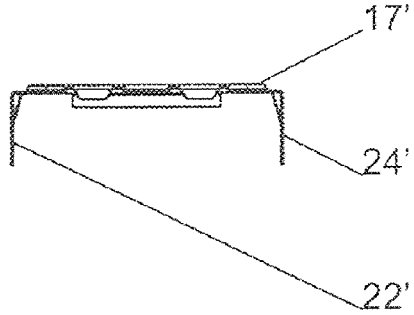
FIG. 15 shows the same, in front view.

As can be seen particularly from FIGS. 11 and 12, a significant difference between the plate 2' and the step 2 consists in that in the case of the plate 2' the two transverse members 22' and 24' are deep-drawn from one sheet metal piece. There is indeed—just as was explained for the step—a division into two in the centre of the plate so that the plate support 17' is thus formed in total from two pieces of sheet metal; each part of the plate support 17' has, however, not only a part of the cross member 22', but also a part of the cross member 24'.

It is particularly advantageous with a plate 2' that the plate support 17' can be of symmetrical construction in longitudinal direction and in transverse direction. The two parts of the plate support 17' can thus be shaped identically. Relief notches 18' are present analogously to the step.

Figure 16:
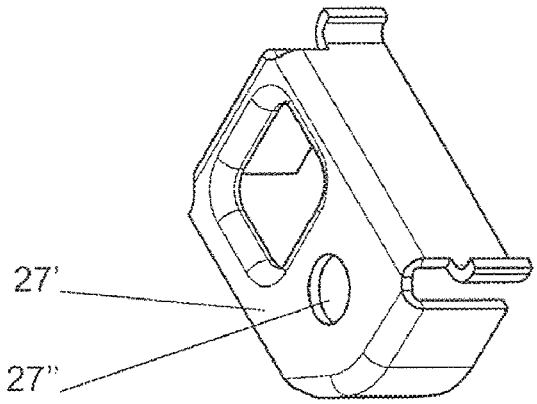
FIG. 16 shows a closure plate, in perspective view.
Figure 17:
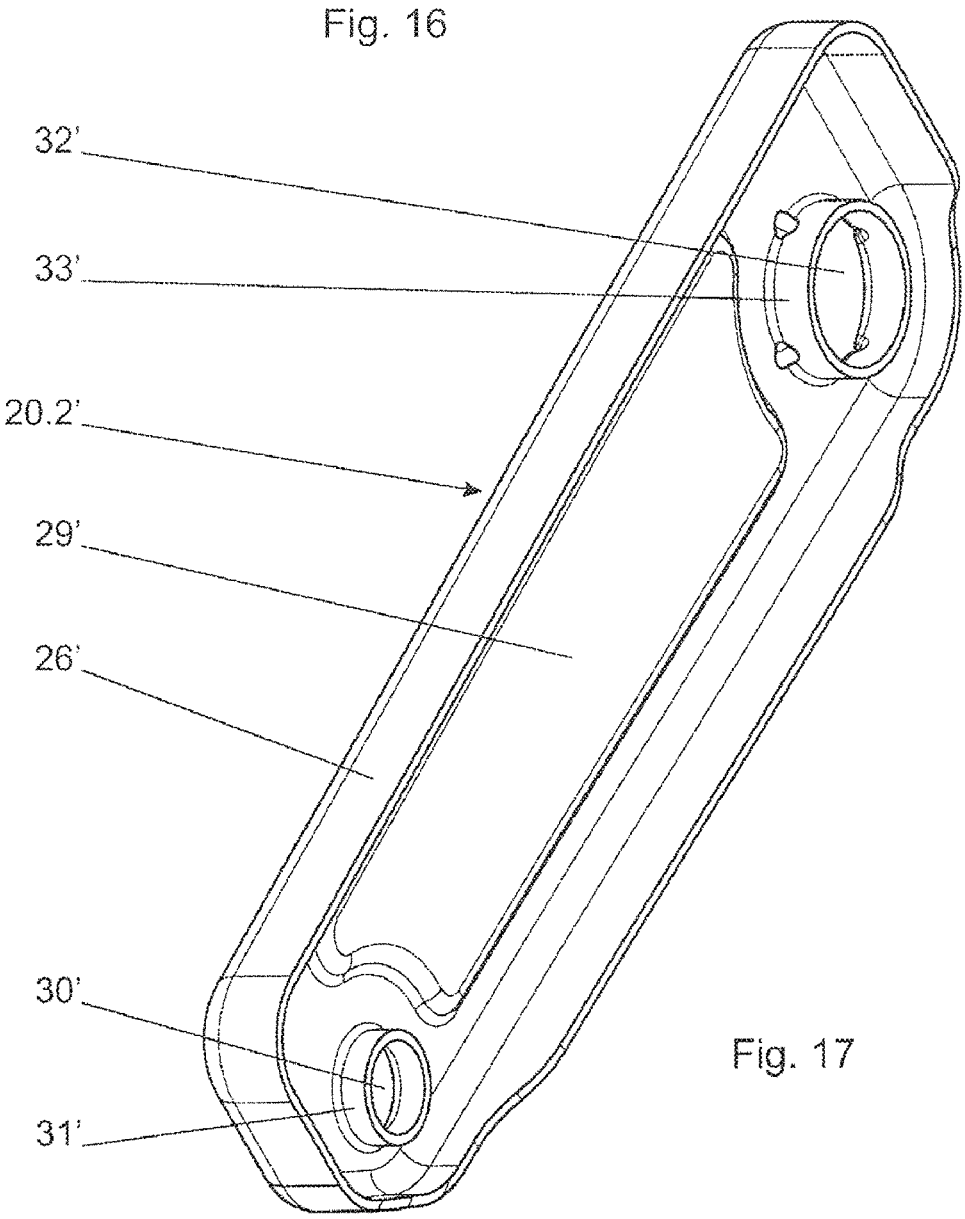
FIG. 17 shows a plate cheek in perspective view, from the inside.
Figure 18:
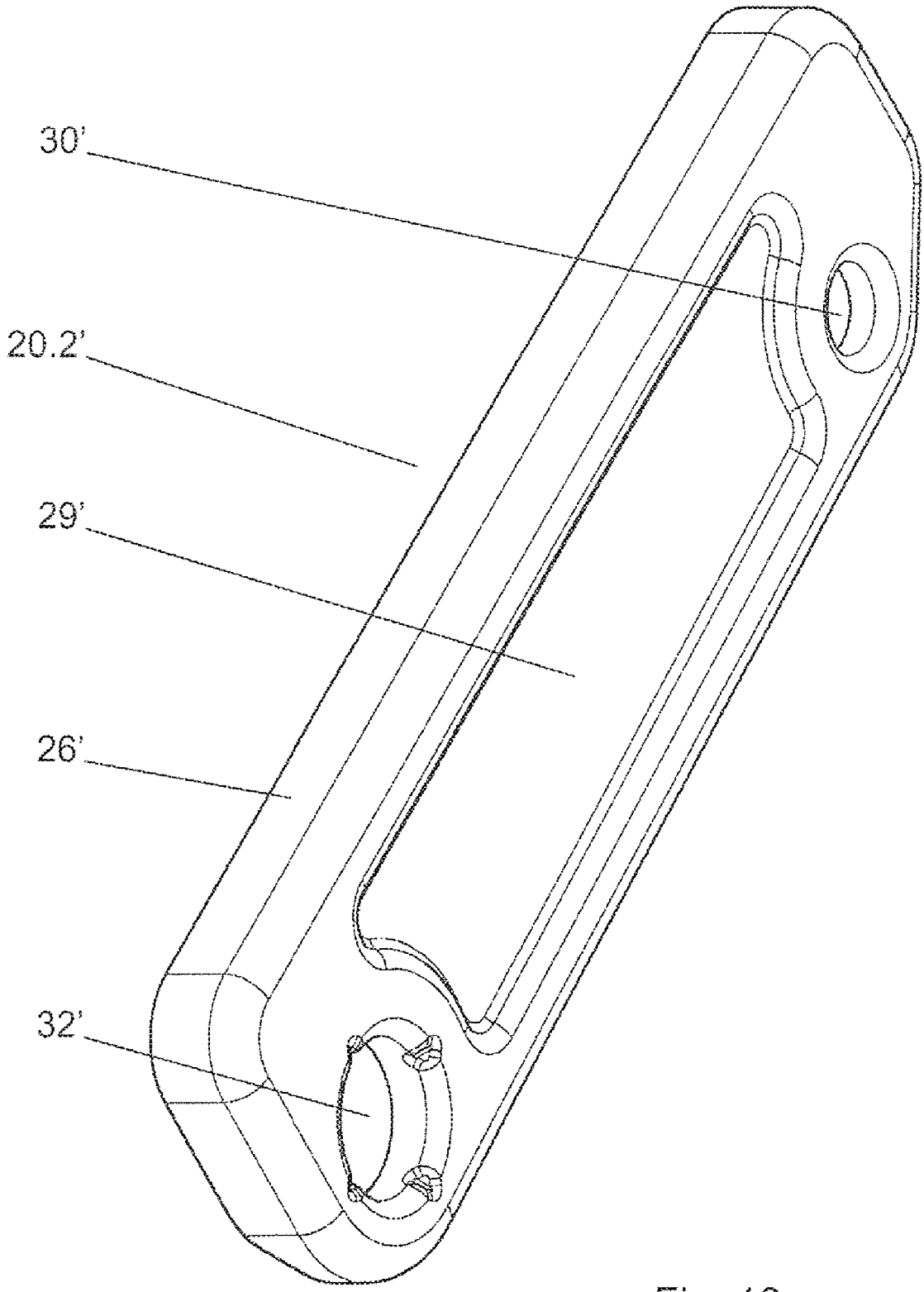
FIG. 18 shows the same, in perspective view, from the outside.

The construction of the plate cheeks 20.2', which are connected with the plate support (for example welded), is seen in FIGS. 16 to 18. Each plate cheek 20.2' has a drag roller eye 30' and a plate eye 32', both of which are surrounded by a sheet metal collar 31' or 33', respectively, which was produced by deep-drawing. A closure plate 27' (see FIG. 16) having an opening 27" for reception of the drag roller axle serves for stiffening the drag roller eye 30'. It is so fastened on the plate cheek 20.2' (for example welded) that the opening 27" and the drag roller eye 32' are coaxial (see FIG. 11). The drag roller axle is thus mounted at two axially spaced-apart points. Since the two chain pin axles 21.1' and 21.2' are connected together by way of the plate axle 21.3', no torsion forces act on the plate eyes 32' so that a closure plate is not necessary. The plate axle 21.3' is mounted in the longitudinal member 23'. The connection with the chain pin axles 21.1' and 21.2' is by way of shackles 21.1" and 21.2".

The invention claimed is:

1. A support for a step or plate of a conveying device, wherein the support comprises:

a rear cross member and a front cross member which define a plane for receiving a tread element;

two outer cheeks, wherein the cheeks are arranged on opposite sides of the support substantially perpendicularly to the rear and front cross members, wherein the two cross members are made of deep-drawn sheet metal and connected to the cheeks to form a load-bearing frame and have a height extending between a lower and a top edge, the height of each cross member at ends thereof being less than the height of the cross member at a center thereof, whereby each cross member exhibits a downwardly-directed bulged shape.

2. A support according to claim 1, wherein the height of each cross member at its center is between 1.5 and 2 times the height of the cross member at the ends thereof.

3. A support according to claim 1 or 2, wherein the cross members are constructed and arranged to have a uniform distribution of stress under load.

4. A support according to claim 1 or 2, wherein a strut connects the two cross members, the strut being made of deep-drawn sheet metal.

5. A support according to claim 1 or 2, wherein at least one of the front and rear cross members is composed of righthand and lefthand member sections or has a mirror symmetry.

6. A support according to claim 1 or 2, wherein at least one of the front and rear cross members and/or cheeks consists of deep-drawn sheet metal and has a three-dimensional profile.

7. A support according to claim 1 or 2, wherein at least one of the front and rear cross members and/or step cheeks has at least one of a recess, bead, moulding or relief notch.

8. A support according to claim 1 or 2, wherein the sheet metal has a thickness between 0.75 millimeters and 1.9 millimeters.

9. An escalator step or moving walkway plate with a support according to claim 1 or 2.

10. An escalator step or moving walkway plate according to claim 9, wherein the step or plate has a tread and riser, at least one of the tread and riser being made of deep-drawn sheet metal.

11. An escalator step or moving walkway plate according to claim 10, wherein the at least one of the tread and riser is mechanically connected with the support by way of a connector chosen from the group consisting of quick-action fastening means, clamping washers, grip rings and fastening means to form an inherently load-bearing unit whereby the at least one of the tread or the riser is reversibly insertable, pluggable or exchangeable.

12. An escalator step or moving walkway plate according to claim 10, wherein the at least one of the tread and riser is formed from one of the group consisting of stainless steel sheet, steel (fine) sheet, pre-galvanized sheet metal, copper sheet, electrolytically dip-coated sheet metal, and hot-dip galvanized sheet metal.

13. An escalator step according to claim 10, further comprising fastening rails located at at least one of a rearward surface of the tread facing the step support in a mounted state and an underside of the riser element facing the step support in the mounted state, the fastening rails having fastener-receiving regions.

14. A moving walkway plate according to claim 10, further comprising fastening rails located on a rearward surface of the tread facing the plate support in the mounted state, the fastening rails having fastener-receiving regions.

15. A conveying device having with a plurality of steps or plates according to claim 10.

16. A conveying device according to claim 15, wherein at least one cheek has at least one eye for reception of a chain pin axle of a chain or conveying chain and a chain pin axle.

17. A conveying device according to claim 16, wherein an encircling sheet metal collar is present in the region of the eye.

18. A conveying device according to claim 16, wherein at least one cheek has at least one drag roller eye for receiving a drag roller axle or drag roller or a drag roller axle with a drag roller.

19. A conveying device according to claim 18, wherein at least one cheek has an encircling sheet metal collar at the region of the drag roller eye.

20. A conveying device according to claim 15, wherein at least one of the front and rear cross members has at least one of the group consisting of a bead, passage, recess, relief notch, fastening region, fastening location, fastening island, fastening tower and fastening elevation.

21. A conveying device according to claim 15, wherein at least one cheek has at least one bead, passage or recess.

* * * * *